United States Patent [19]

Hauk et al.

[11] 4,232,752

[45] Nov. 11, 1980

[54] METHOD AND APPARATUS FOR DRIVING PIPE

[75] Inventors: Ernest D. Hauk, Yucca Valley; Jesse C. Kirkpatrick, Mission Vijeo, both of Calif.

[73] Assignee: Service Equipment Design Co., Inc., Signal Hill, Calif.

[21] Appl. No.: 888,312

[22] Filed: Mar. 20, 1978

[51] Int. Cl.[2] ..... E21B 1/02

[52] U.S. Cl. ..... 175/135; 173/28; 173/133; 173/137; 175/171; 175/173; 175/207

[58] Field of Search ..... 175/171, 65, 207, 173, 175/135, 171; 173/91, 105, 135, 133, 137, 28

[56] References Cited

U.S. PATENT DOCUMENTS

| | | | |
|---|---|---|---|
| 1,292,429 | 1/1919 | Bull | 173/91 |
| 1,658,330 | 2/1928 | Gilman | 173/105 |
| 3,154,158 | 10/1964 | Lincoln | 173/135 |
| 3,511,325 | 5/1970 | Schmidt | 173/91 |
| 3,583,499 | 6/1971 | Cordes | 173/131 |
| 3,625,295 | 12/1971 | Gunnin | 173/15 |
| 3,645,343 | 2/1972 | Mays | 173/147 |
| 3,788,423 | 1/1974 | Nittinger et al. | 175/209 |
| 3,833,072 | 9/1974 | Back | 175/171 |
| 3,895,680 | 7/1975 | Cook | 173/132 |
| 3,961,672 | 6/1976 | Welsch | 173/137 |

FOREIGN PATENT DOCUMENTS

| | | | |
|---|---|---|---|
| 1909931 | 9/1969 | Fed. Rep. of Germany | 175/135 |

*Primary Examiner*—William F. Pate, III.

*Attorney, Agent, or Firm*—Gausewitz, Carr, Rothenberg & Edwards

[57] ABSTRACT

A casing hammer for driving casing while drilling a water well comprises a housing having an annular pneumatic chamber with a relatively lightweight, short-stroke annular piston. The piston is reciprocably driven at a high rate to provide a large number of light blows of controllable energy upon an annular anvil that seals one end of the chamber. Percussive blows upon the anvil are transmitted through a drive head and adapter to the upper end of the pipe to be driven. The hammer is suspended from a rotary drive head that operates a hollow drill string extending downwardly through the hammer and through the casing driven thereby.

29 Claims, 14 Drawing Figures

14
25
246
250
252
248
40
254
256
100
46
56
78a
76a
78c
76e
90
92
94
96
68
74
120
122a
122c
62
48
106
108
133
156
154
132
130
135
134
136
30

14
25
246
250
252
248
40
254
256
46
76a
78a
78c
76e
90
92
94
96
100
68
74
122a
122c
62
106
48
108
156
154
132
133
130
135
134
136
30

METHOD AND APPARATUS FOR DRIVING PIPE

BACKGROUND OF THE INVENTION

The present invention relates to methods and apparatus for well drilling and more particularly concerns a hammer for driving casing while permitting access to the casing interior.

Many types of wells are lined either partially or completely with well casing. In the drilling of such wells it has been the practice to carry out the steps of drilling and lining alternately. Thus a drill bit is driven into the ground to remove material from the well, the drill bit is then removed and a section of casing sunk into the well. Then the drill bit is again inserted to drill another section of well which is lined after removal of the drilling tool.

In the drilling of water wells there has been adopted a method of drilling in which the casing is driven at the same time that the well is being drilled, with air forced downwardly through the drill string to remove loose material. Apparatus for carrying out such combined well drilling and casing driving is described in a U.S. Pat. No. to Back 3,833,072 and in patents to P. M. Cook 3,474,870 and Re. 28,151 and A. B. Cook 3,895,680.

In the P. M. Cook patents a heavy, hollow ram is raised by a pair of cylinders mounted on the outside of the ram in an arrangement in which the large heavy ram of relatively long stroke requires a relatively long hammer frame. The addition of such a long hammer to many existing drilling rigs requires that the rig frame be lengthened considerably in order to accommodate both the extra length of the hammer and standard lengths of twenty or twenty-five foot pipe. The arrangement of P. M. Cook, employing a relatively massive ram and imparting energy that is obtained mainly from the fall of the ram, is a relatively slow acting device, being operated at the rate of approximately one blow per second in a common operation. The force of the blow in the P. M. Cook apparatus, being largely determined by the weight of the ram, is not readily adjustable.

The A. B. Cook patent is subject to similar problems, using a ram considerably larger than the driving piston and thus, because of the large mass of the ram, severely limiting its rate of reciprocation.

It is frequently desirable to increase or decrease the force of each blow struck upon the pipe in accordance with the particular medium through which the pipe is being driven, the size of the pipe, and other conditions at a given well site. Such adjustment is not readily or conveniently available with the apparatus such as shown in the Cook patents where the fixed weight of a massive ram is a significant factor in the force of each blow.

In the patent to Back U.S. Pat. No. 3,833,072, instead of relying upon the weight and long stroke, the apparatus is driven by hydraulic pressure described as being 2,000 pounds per square inch, providing an impact energy of 4,765 foot pounds, at a frequency of thirty strokes per minute. Thus again a relatively low rate of exceedingly high energy blows is employed. These high energy blows are destructive to the driven pipe and its connections and to the hammer itself. All of the impact energy in the Back patent is transmitted directly to the hammer cylinder, which acts as the anvil, and thus the entire hammer receives the energy of each blow. Not only is this detrimental to the life of the hammer, but it creates considerable inefficiency since the entire hammer must be accelerated upon each blow and much of the kinetic energy of the piston is absorbed by the mass of the hammer. Thus the prior art teaches use of a large, massive device to either develop the impact energy or to transmit the impact energy so that the apparatus is either slow acting, inefficient, or both.

Accordingly it is an object of the present invention to provide a pipe hammer that eliminates or minimizes above-mentioned disadvantages.

SUMMARY OF THE INVENTION

In carrying out the method of the present invention in accordance with a preferred embodiment thereof, combined well drilling and casing driving is achieved by driving a hollow drill string through a casing positioned around the drill string, forcing fluid downwardly through the drill string and upwardly around the drill string and within the casing, and transmitting impact blows to the casing at a high rate. The impact blows are preferably transmitted by a high-speed lightweight annular piston which is pneumatically driven to provide a high rate of percussive blows that individually are of relatively low energy.

A preferred apparatus for practicing the method comprises a housing having a bore and defining an annular chamber sealed at one end and circumscribing the bore. An annular piston is mounted for reciprocation in the chamber and an annular anvil is movably mounted to the housing and seals the other end of the chamber. Impact of the piston directly upon the anvil is arranged to transmit percussive blows to the pipe and the piston is reciprocated at a high rate with blows of readily controllable energy.

DETAILED DESCRIPTION

Figure 1:
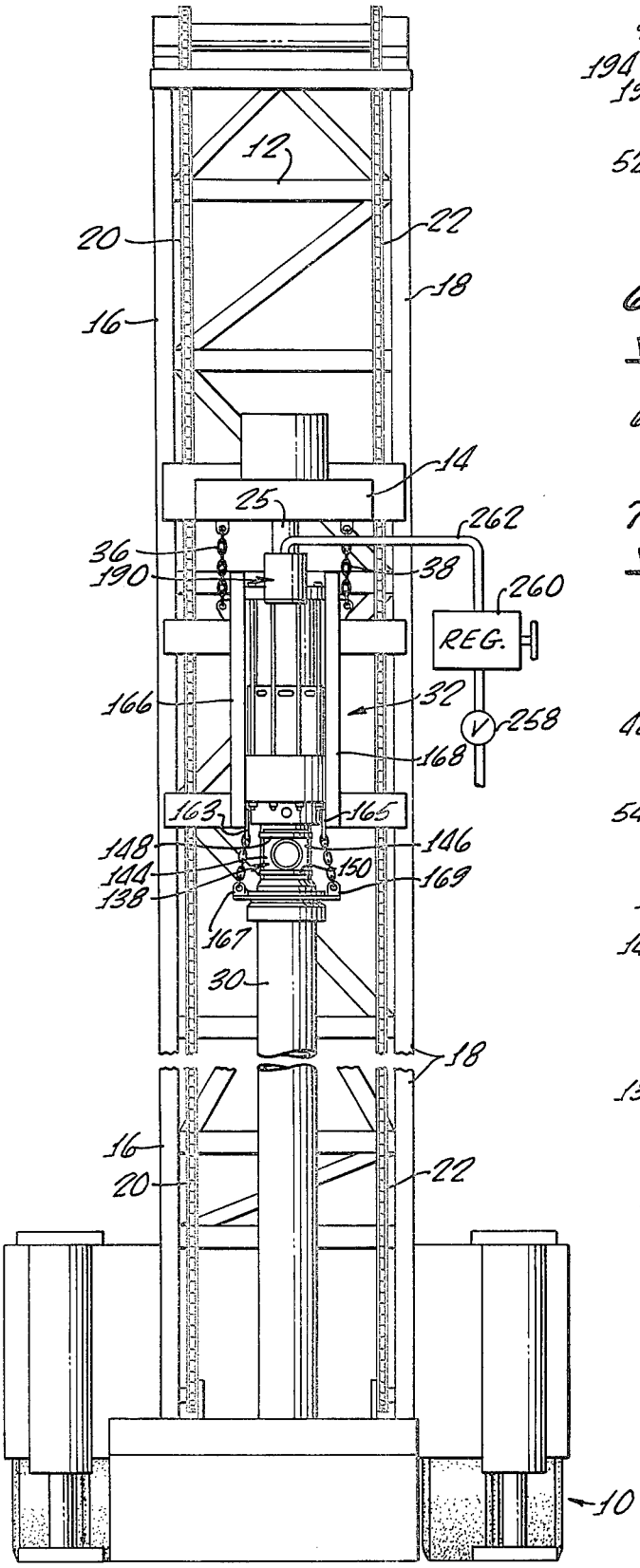
FIG. 1 illustrates a portable drilling rig of conventional construction mounting a pipe hammer embodying principles of the present invention.
Figure 2:
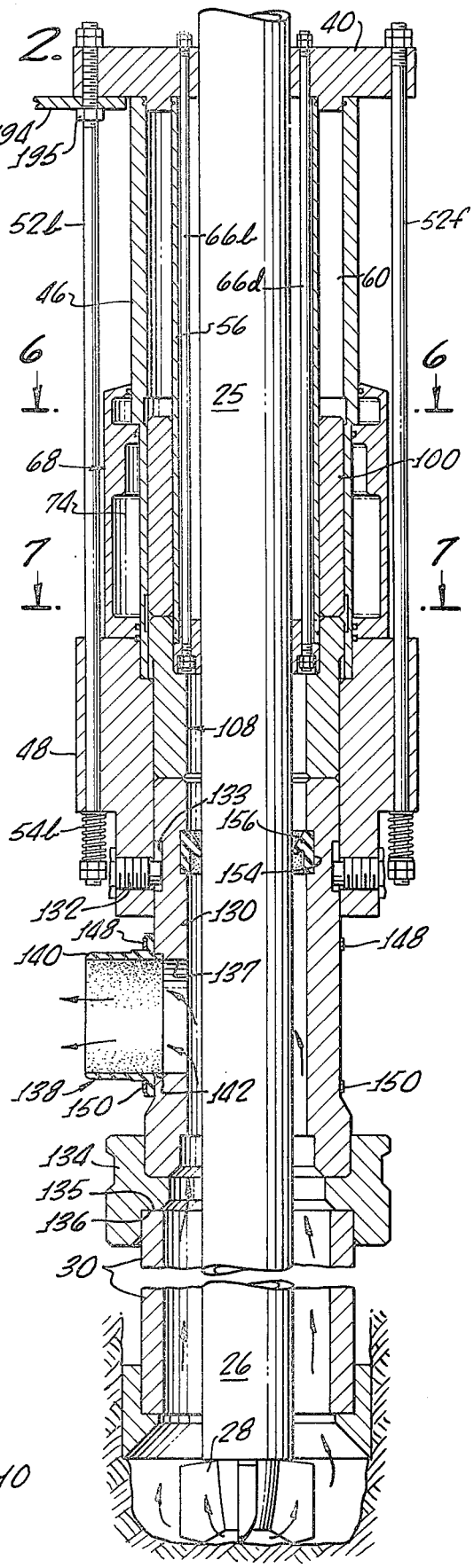
FIG. 2 is an enlarged sectional view of the hammer, taken on lines 2—2 of FIG. 5, illustrating the relation of drill string, casing and hammer, and omitting the supporting rig.

As illustrated in FIG. 1 a conventional drilling rig is mounted on a vehicle 10 and includes a frame 12 that is positioned generally vertically when in operation. The vehicle and frame are conventional and details thereof form no part of this invention. Briefly, a cross head 14 is slidably mounted in upright guide tracks 16, 18 that extend substantially the length of the frame. The cross head is carried by continuous chain 20, 22 entrained over chain wheels (not shown) at the top and bottom of the frame. Means, not shown, are provided to move the chain and thereby raise the cross head and permit it to be lowered. In the conventional rotary drill rig the cross head mounts a rotary drive which includes a downwardly extending hollow stub 25 detachably connected to the uppermost section of conventional hollow drill string 26 having at the lowermost end of the string a conventional rotary drill bit 28 (FIG. 2). Suitable conduits (not shown) carry power to the cross head for rotation of the stub and drill string and for supplying air under pressure to the interior of the drill string.

Where well casing is to be driven while the well is being drilled, and as is now practiced in drilling of water wells, a length of casing 30 surrounds the drill string and extends upwardly to a point adjacent the upper end of the string. Interposed between the upper end of the casing 30 and the rotary cross head 14, and circumscribing the stub 25, is a hammer, generally indicated at 32, embodying principles of the present invention. The hammer is suspended, to be raised when necessary, by means of a pair of short chains 36, 38 connected between the upper end of the hammer and the lower side of the rotary cross head. The hammer is also guided for vertical movement along the guide tracks 16, 18.

The hammer basically comprises a housing having a central bore and an annular chamber closed at its rear (normally upper) end and slidingly mounting a sealing anvil at the other end. The anvil is directly struck by a reciprocating piston so as to be driven a short distance outwardly of the forward (normally lower) end of the chamber.

The hammer housing is formed of an end plate or cap 40 having a central bore 42 and an annular rib 44 projecting forwardly from a forward face thereof. An outer sleeve in the form of a right circular cylinder 46 has its rear end butted against the forward surface of the cap 40 and against the outer peripheral face of the rib 44. A forward housing 48 of generally annular configuration has the inside of its rearward end enlarged to provide a seat 50 (FIG. 8) that butts against the forward end of the outer sleeve 46. A plurality of outer tensioning tie rods **52*a*, 52*b*, etc., extend entirely through the front housing, rearwardly along the exterior of the outer sleeve and through the end cap, drawing the end cap toward the front section by means of enlarged heads or nuts on the forward end of the tie rods and nuts on the rear ends. To absorb some of the shock loads imparted to the housing, each tie rod has a spring such as spring 54*a*, 54*b*, etc. (FIG. 3**), compressed between its lower or forward head and the forward end of the front housing.

An inner sleeve in the form of a right circular cylinder 56 is concentric with the outer sleeve 46 and has its rear end firmly abutting the forward face of the end cap and firmly positioned against the inwardly facing surface of rib 44. Sealing O-rings 58, 59 are interposed between the opposite faces of the rib 44 and the adjoining surfaces of the sleeves to seal the rear end of th annular chamber 60 which is formed between the concentric sleeves.

An annular retainer 62 has the outer surface of its rear end rebated as at 64 to provide a seat that firmly abuts the forward end of the inner sleeve 56. The outwardly facing surface of the rebated end of the retainer closely engages the inner surface of the forward end of the inner sleeve. The retainer and end cap are drawn toward each other by a plurality of inner tie bolts **66*a*, 66*b***, etc., which extend entirely through the retainer, upwardly along the inner surface of the inner sleeve and through the end cap, and are held in place by bolts threaded onto both the rear and forward ends of the inner tie rods. The retainer maintains concentricity and relative positioning of the forward ends of the two sleeves.

A return chamber body 68 circumscribes the outer sleeve and has upper and lower radially inwardly directed peripheral flanges 70, 72 that abut the outer surface of the outer sleeve to space the main chamber body portion away from the outer sleeve, thereby to define an air return chamber 74 between the chamber body 68 and the outer surface of the outer sleeve. Chamber body 68 is formed with a plurality of radially outwardly directed ports **76*a*, 76*b*, etc., which are not in communication with the chamber 74, but are in communication with a plurality of apertures 78*a*, 78*b*, etc., extending radially through the outer sleeve 46 substantially midway between the upper and lower sections of the annular chamber 60. The return chamber body 68 is sealed to the outer sleeve by means of O-rings 80, 82 and 84, and a further O-ring 86 seals the front housing 48 to the chamber body 68 and to the outer sleeve 46. The inner surface of inner sleeve 56 is sealed to the retainer 64 by an O-ring 88**.

Chamber body section 68 is formed with a pair of return fittings 90, 92, connected to air return hoses 94, 96.

An annular piston 100, having a length somewhat less than half the length of the annular chamber, is slidably mounted therein and is formed with a plurality of peripheral grooves such as indicated at 102, 104 on both inner and outer surfaces to entrap air and oil for lubrication of the sliding motion of the piston in the annular cylinder. The piston forms the ram of this hammer and is driven at a high rate of reciprocation, the speed of the ram and the supplied air pressure primarily determining the impact energy that is imparted to the driven casing.

The lower end of the annular chamber 60 is sealed by means of an annular anvil 106 mounted for limited sliding motion within the annular chamber. The anvil has a forward driving portion 108 that is positioned outwardly of the chamber 60 and is formed with a rearwardly facing seat 110 that is adapted to engage the forward facing end of retainer 62 to limit motion of the anvil inwardly of the chamber 60 (toward the rear of the hammer). The rearward end 112 of the annular anvil is formed with an outer peripheral enlargement having an inclined forwardly facing shoulder 114 that cooperates with an inclined rearwardly facing shoulder 116 on the inner surface of the front housing 48 to provide a stop that limits forward motion of the anvil and prevents the anvil from sliding completely out of the chamber. The rear face of the anvil is rounded or chamfered on both inner and outer edges, as indicated in the drawing, and is adapted to be directly struck by the forward face of the piston which likewise is rounded or chamfered on both inner and outer edges, as shown.

When the hammer is at rest upon a casing to be driven, the chamber sealing anvil is in its maximum retracted position with shoulder 110 in abutment with the front face of the retainer 62. The plane of contact 118 between the piston and anvil is positioned slightly above the forward end of a peripheral recess 120 formed in the inner surface of the lower end of the outer sleeve 46. Annular recess 120 communicates with the return chamber 74 by means of apertures 122*a*, 122*b*, etc., extending through the outer sleeve wall.

The forward end of the front housing extends forwardly of the forward end of the anvil, the latter projecting forwardly of the forward end of the retainer 62. An annular drive head 130 is slidably mounted within this forward portion of the front housing, having its outer surface dimensioned to be a sliding fit upon the inner surface of the front housing. Drive head 130 is slidably retained in the housing by a plurality of bolts 132 (FIG. 2) which are threaded through the housing and extend into a peripheral recess 133 formed in the outer surface of the drive head. The recess extends axially for a distance sufficient to permit limited relative sliding motion of the drive head and front housing.

The lower end of drive head 130 is received within the rear end of an adapter collar 134 and seats upon a rearwardly facing annular shoulder 135 thereof. The collar is preferably made in two sections detachably bolted together and is formed with a forwardly facing bearing shoulder 136 adapted to seat upon and transmit percussive blows to the upper end of the casing 30 that is to be driven by the hammer. Different adapter collars are employed with casing of different diameters. All adapters have the same dimensions at the rear for receiving the forward end of the driving head, but have forward sections (including bearing shoulder 136) dimensioned to accommodate a specific casing size.

Figure 3:
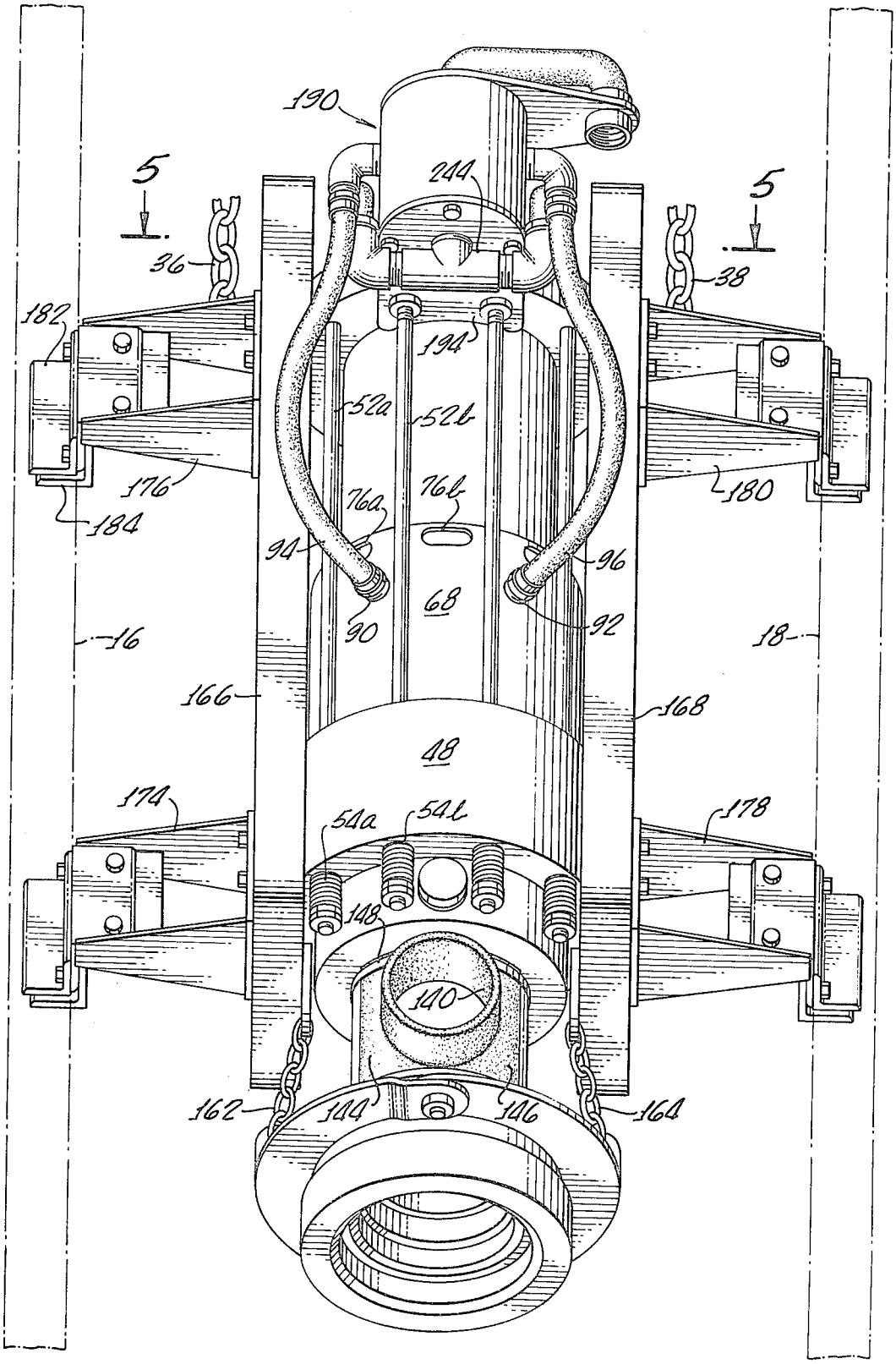
FIG. 3 is a perspective view of the hammer of FIG. 1.
Figure 4:
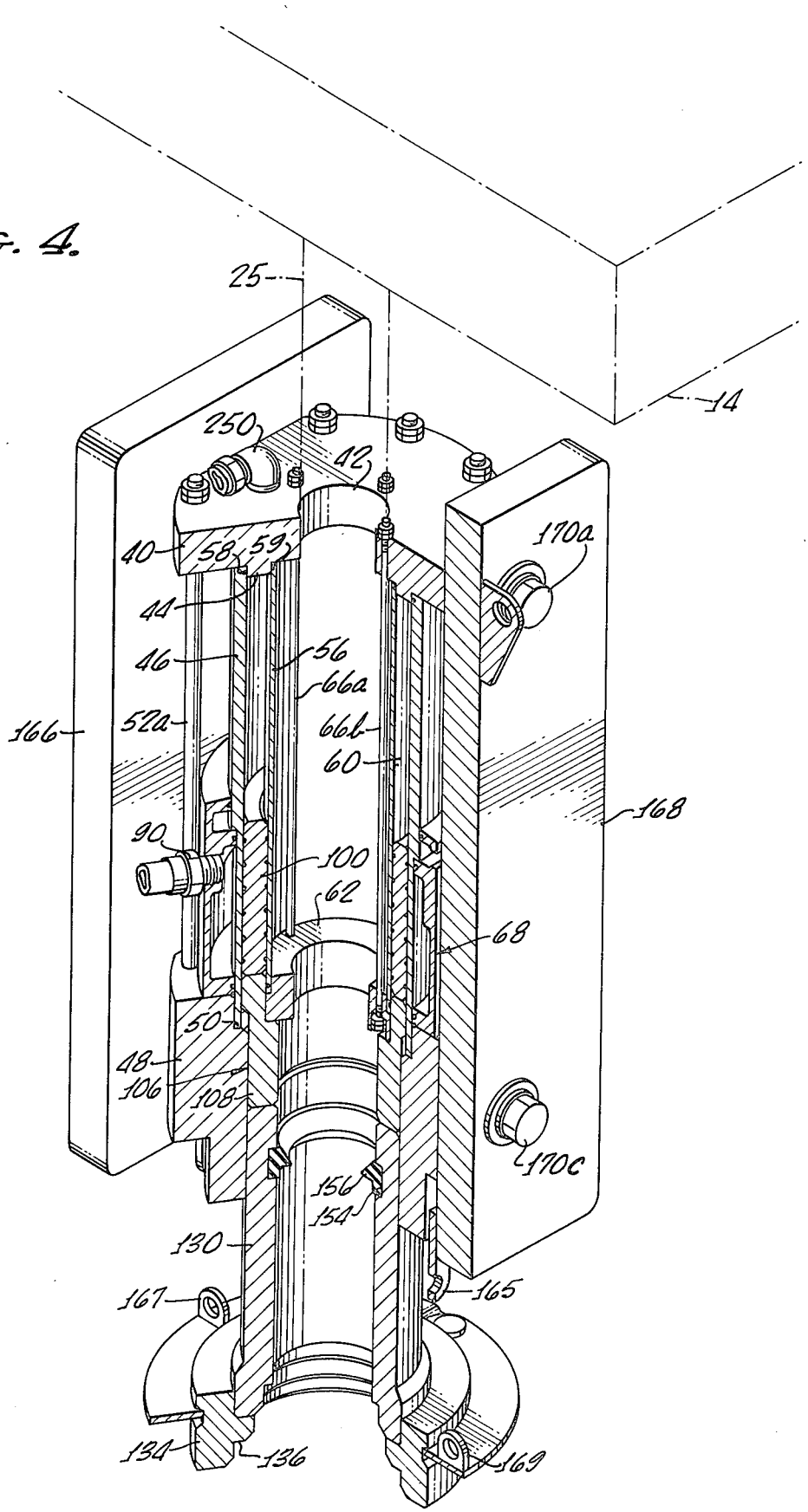
FIG. 4 is a perspective view of the hammer with parts broken away.

Drive head 130 has a discharge aperture 137 in which is resiliently mounted a flexible discharge fitting generally indicated at 138 (FIGS. 1, 2, 3). Fitting 138 comprises a substantially cylindrical conduit section 140, having a short inner stub section 142 that extends into the drive head aperture 137 to position the discharge fitting in the discharge aperture. Integrally formed with the stub section 140 are first and second oppositely disposed and laterally projecting arms 144, 146 (FIGS. 1, 3) that are curved to conform with the external configuration of the drive head. A pair of securing bands, such as metal clamps or the like, 148, 150, encircle the drive head, extending over the arms 144, 146 to firmly and resiliently secure the discharge fitting to the drive head. A suitable discharge hose (not shown) may be connected to the stub section 140 if deemed necessary or desirable. Preferably, the discharge fitting is integrally molded of a rubber or other elastomer which may be reinforced with suitable metal or other reinforcing elements (not shown).

The internal surface of the drive head to the rear of the discharge fitting 138 is formed with a peripheral recess 154 that receives and retains an annular seal 156 protruding radially inwardly of the drive head to abut and seal against the outer surface of a length of drill string stub 25 that extends from the rotary head through the hammer and to the casing 30.

Figure 5:
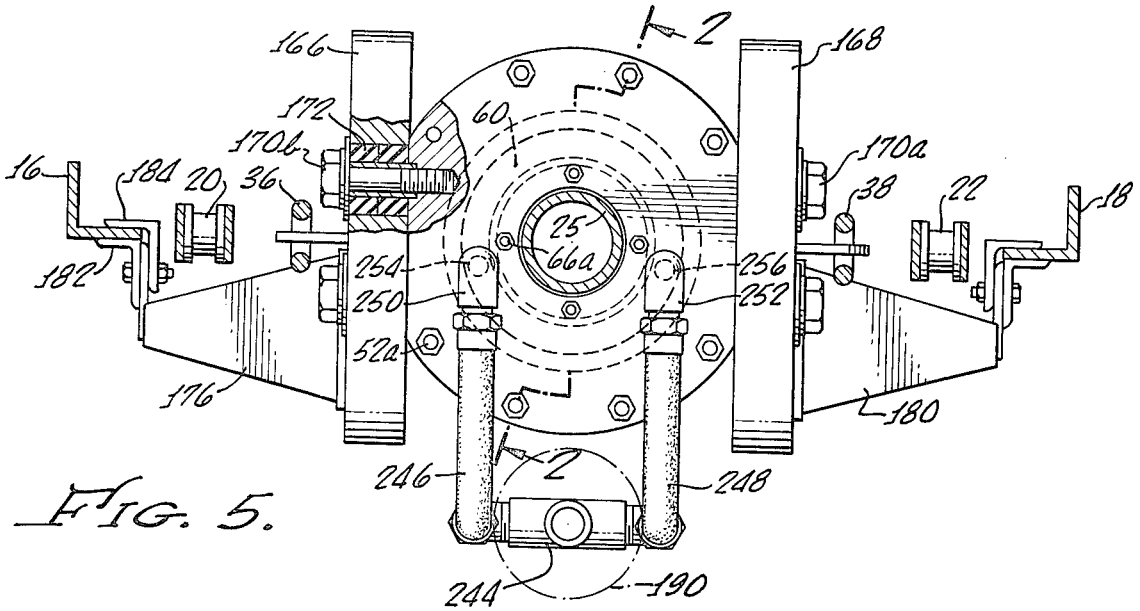
FIG. 5 is a section taken on lines 5—5 of FIG. 3.
Figure 6:
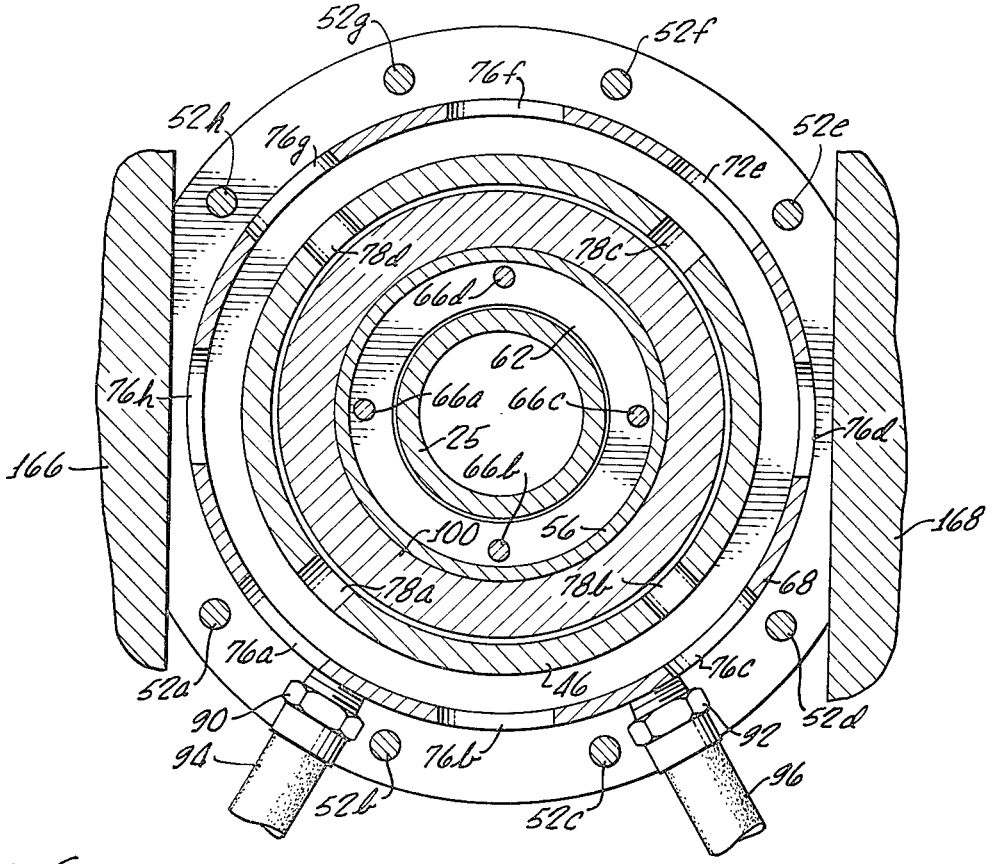
FIGS. 6 and 7 are views taken on lines 6—6 and 7—7, respectively, of FIG. 2.
Figure 7:
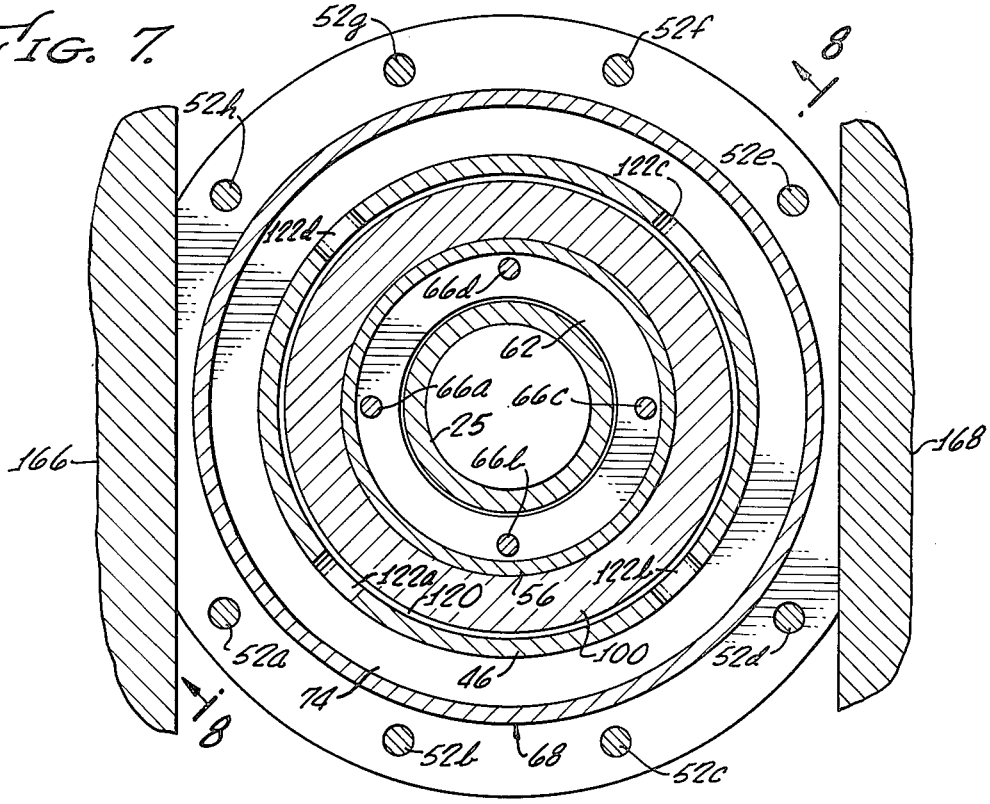

Adapter collar 134 is suspended from the housing by means of a pair of short chains 162, 164 connected to and between the collar and the front end of the front housing. During operation of the hammer the chains take no load and the entire hammer is supported by the collar upon the casing. Ballast plates 166, 168, which provide pre-loading of the hammer, are bolted to the end cap and front housing respectively by means of bolts 170*a*, 170*b*, etc. extending through the ballast plates and threaded into the end cap and front housing. Resilient mountings 172 (FIG. 5) line the bolt apertures in the ballast plates to cushion the shocks imposed upon the connected members. The collar supporting chains are connected to apertured brackets 163, 165 welded to the front of the hammer, as at the front of the ballast plates, and to apertured ears 167, 169 on the collar.

Each ballast plate has fixed thereto forward and rear laterally extending brackets 174, 176 and 178, 180, respectively (FIG. 3). The ends of the brackets fixedly carry a pair of mutually spaced guide angles such as angles 182, 184 for bracket 176. The guideway defined between a pair of adjacent guide angles slidably receives a corresponding vertical track 16 to guide the hammer in its vertical motion.

A pneumatic valve generally indicated at 190 is fixedly carried by the end cap 40 and spaced radially outwardly from the hammer centerline to allow the drill string to pass through the hammer. The valve employs a shuttle that is automatically cycled by pressure differential in valve chambers that are connected to opposite ends of the piston chamber above and below the piston.

Valve 190 (FIG. 11) includes a valve body having a rear wall 192, a front wall 194 and a circular side wall 196. Front wall 194 extends outwardly of the valve body along a forward surface of the end cap (FIG. 2). A pair of the external tie rods 52 extend through apertures in the wall 194 and receive threaded nuts 195 that fix the valve to the end cap. A shuttle guide having a plate 198 extending across the rear of the valve and a stem 200 extending forwardly therefrom has a shuttle 202 mounted thereon for limited sliding motion. The shuttle 202 includes rear and front annular shoulders 204, 206 adapted to seat respectively and alternatively on rear and front shoulders 208, 210 that define internal ports leading to rear and front valve chambers 212, 214, respectively. Rear chamber 212 is defined by the shuttle guide, the shuttle and a rear valve chest 216 mounted in the rear part of the valve. Rear chest 216 bears against the forward face of plate 198 and against the internal surface of the side wall 198, being spaced outwardly of the stem 200. The front valve chamber is defined by the shuttle, the shuttle guide and a valve front chest 218. The front chest bears against the front wall 194, side wall 196 and the front of the rear chest. The several abutting valve components are sealed to one another by suitably positioned O-rings, as shown in the drawings.

The shuttle is smaller than the circumscribing portions of the valve chests to provide a continuous annular passage 219 around the sides of the shuttle, for selective communication with both rear and front valve chambers 212, 214. The rear wall 192 of the valve has a pressure input passage 220 which communicates with the passage 219 immediately surrounding the shuttle by means of an annular passage 224 between the chests, a passage 226 extending forwardly through the rear chest, and through the guide plate 198 and a chamber 228 formed between the plate 198 and rear wall 192. A pin 229 indexes plate 198 and rear chest 216 to insure alignment of the sections of passage 226.

An annular recess 230 is formed in the exterior of the rear chest and communicates with rear chamber 212 by means of a radially extending conduit 232. First and second diametrally disposed return ports, of which only port 234 is seen in the drawings, provide communication through the valve body from the recess 230 to the exterior thereof. The return ports are connected to return hoses 94, 96 (FIG. 3), which communicate with the return chamber 74 of the hammer.

Figure 9:
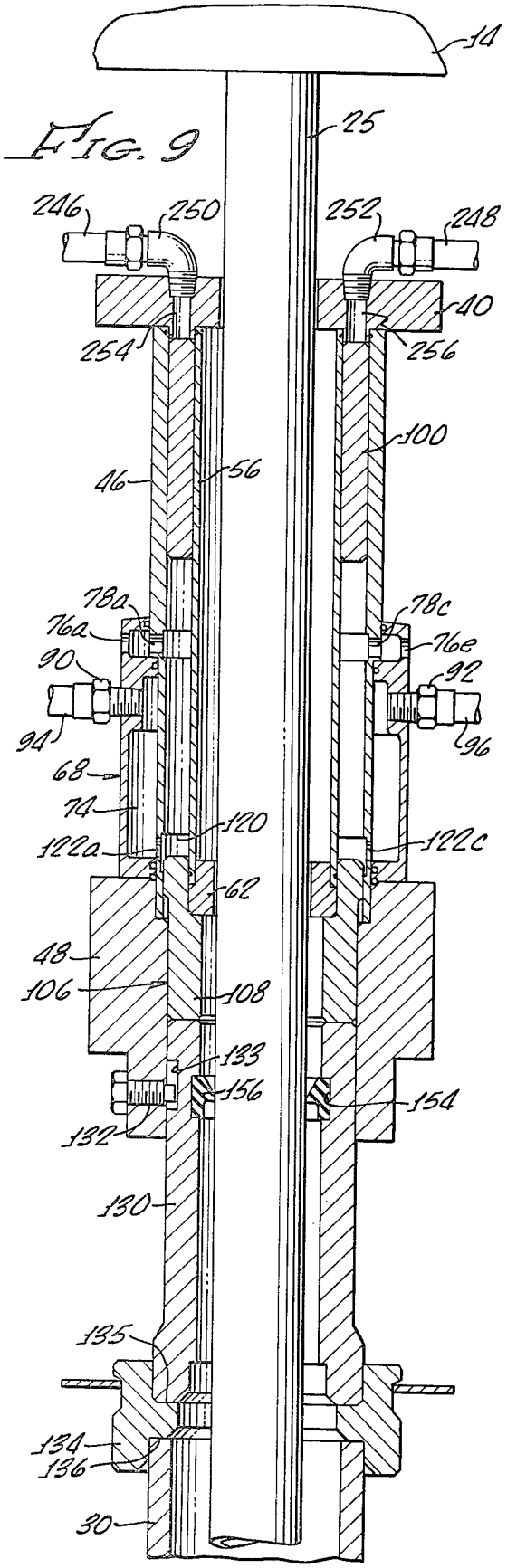
FIG. 9 is a longitudinal sectional view showing the hammer at the top of a stroke with the anvil in retracted position.
Figure 10:
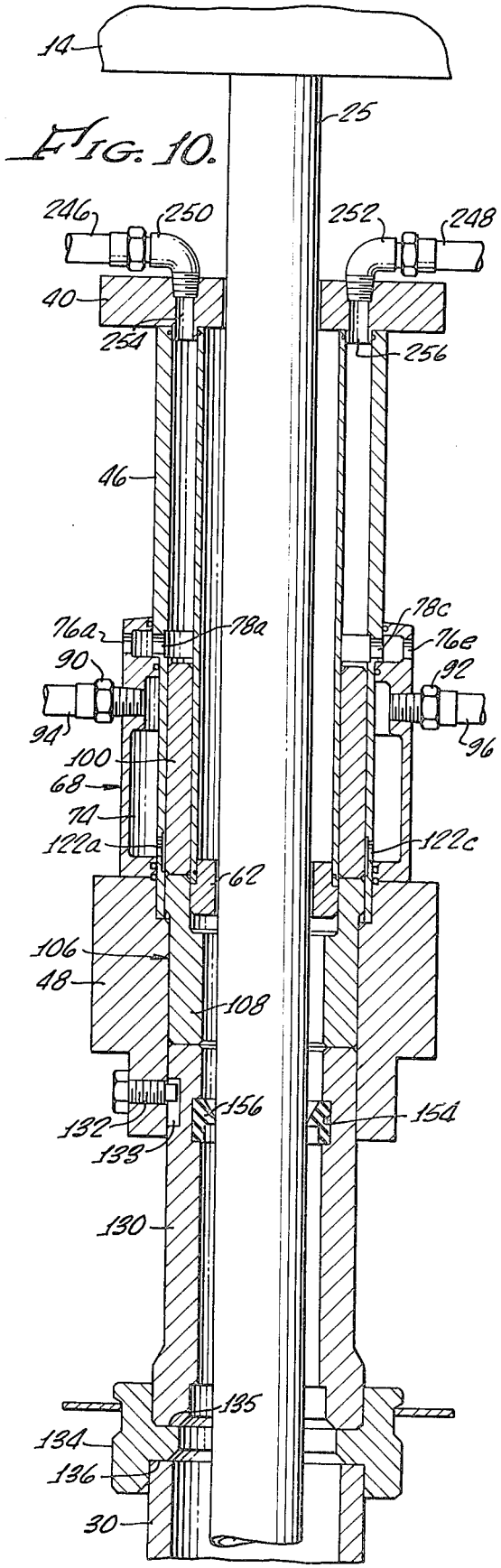
FIG. 10 is a longitudinal section of the hammer showing the piston at the bottom of a driving stroke and the anvil in extended position.

Forward valve chamber 214 is connected by means of a port 240 in forward wall 194 to a T-fitting 244 having the opposite ends thereof connected by flexible hoses 246, 248 (FIG. 5) to elbows 250, 252 which are in turn respectively connected to apertures 254, 256 extending through the end cap 40 into the upper end of the annular chamber 60 (FIGS. 9, 10).

METHOD

In practicing the method of the present invention, the following procedure may be employed with the hammer described above. A new casing section and a new section of drill pipe may be lifted independently or together. It is convenient in some operations to handle each section of drill string while it is within an associated section of casing. Thus after a section of drill string and casing have been driven to a point where their tops are close to, but just above, the ground, the rotary driving stub 25, which depends from the rotary head and extends completely downwardly through the hollow hammer, is disconnected at its lower end from the uppermost end of the driven drill string. In effect the driving stub forms a portion of the driven drill string during drilling. With the stub disconnected from drill section in the ground, the rotary head and stub are raised, lifting the hammer, to an uppermost position. The new casing section and drill string section are lifted together and the upper end of the new drill string section is threadedly connected to the lower end of the rotary head driving stub which extends through the hammer. The new casing and drill string section are then lowered and the lower end of the new drill string section is threaded to the upper end of the drill string section previously driven. Now the new casing section is aligned with and upon the previously driven casing section and the two are welded together. The hammer is now in an upper position, being suspended from the raised rotary head by means of the short chains 36, 38. Obviously other procedures may be employed if deemed necessary or desirable to position the added casing and drill string sections.

Figure 8:
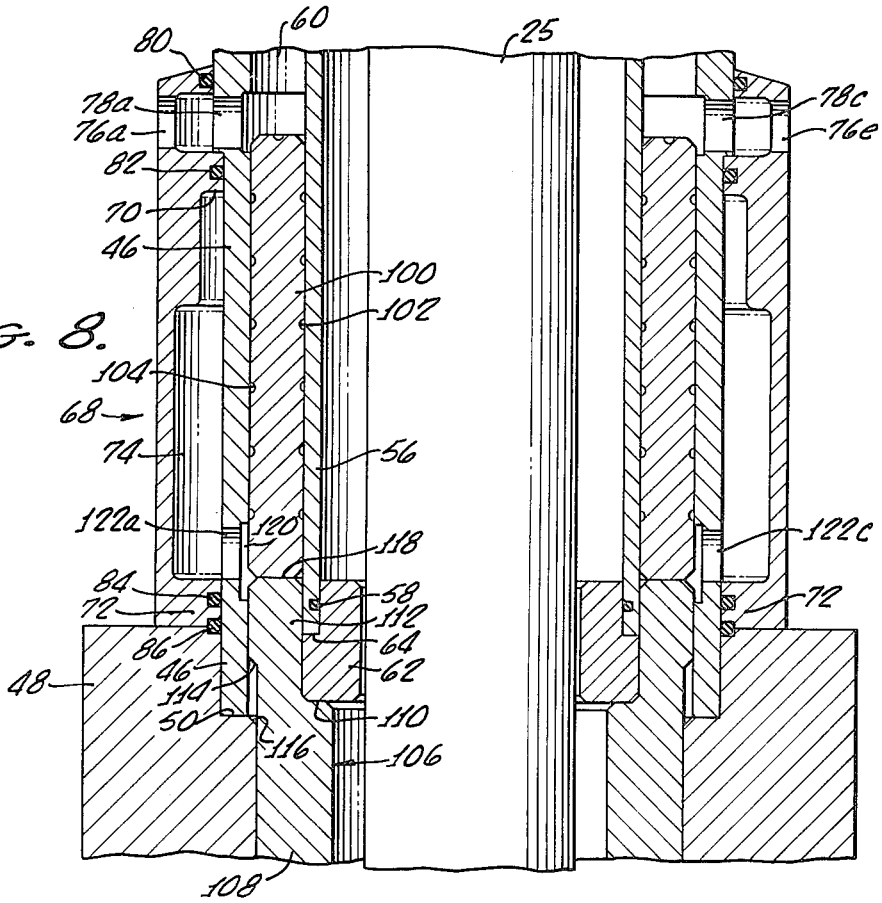
FIG. 8 is a section taken on lines 8—8 of FIG. 7 illustrating details of the lower end of the piston chamber.
Figure 11:
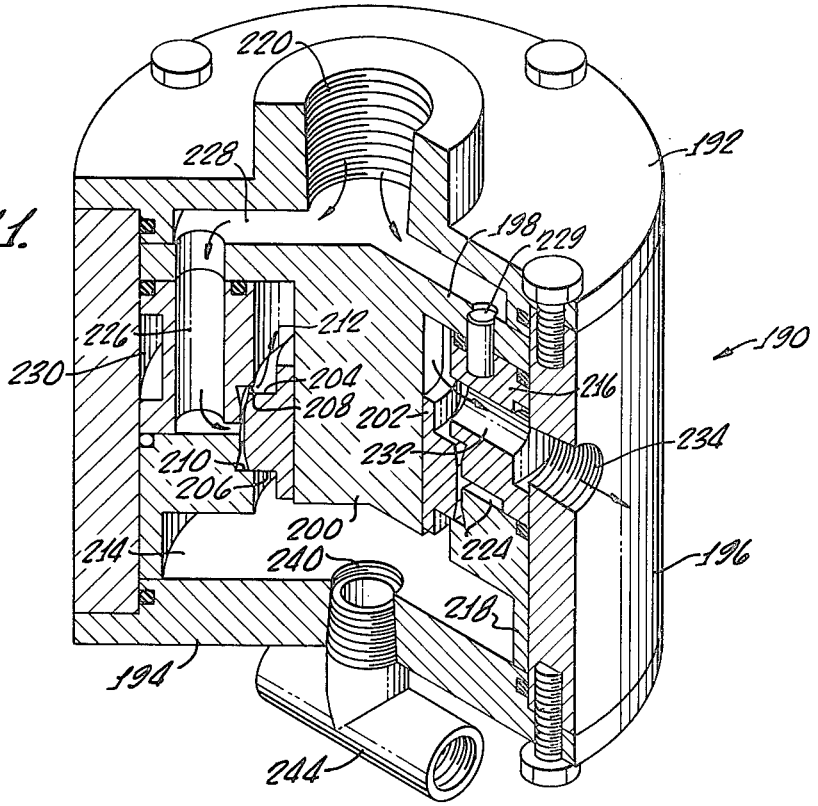
FIG. 11 is a perspective view of the piston operating valve, with parts broken away, showing the valve shuttle in position to lift the piston.
Figure 12:
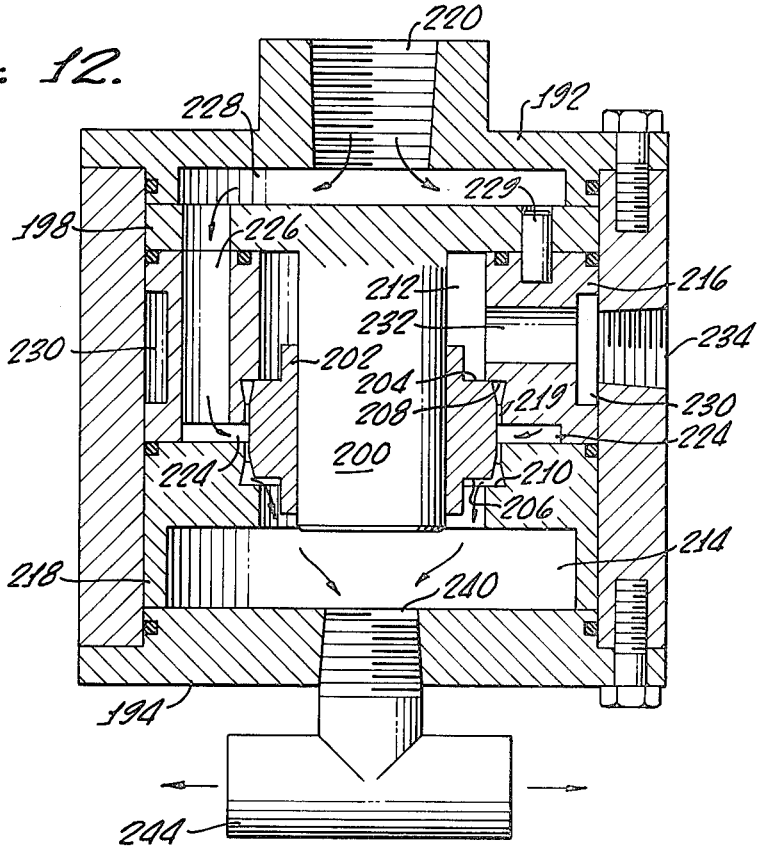
FIG. 12 is a sectional view of the piston operating valve in position to drive the piston forwardly.

The hammer drive head and collar adapter are now above, but not necessarily in contact with, the upper end of the new casing section and the hammer is close to and supported by the raised rotary head. Rotation of the drill string commences, driving the drill string downwardly with the rotary head. The hammer moves downwardly with the rotary head and drill string until the collar adapter seats upon the upper end of the casing. Such seating removes the weight of the hammer from the suspending chains and the hammer is now supported upon the casing. The chains may remain loose, but still connected, for backup support of the hammer. This forces the anvil to the limit of its retracted position with anvil shoulder 110 abutting the forward face of retainer 62. The piston is in its lowermost position, resting upon the rear (upper) face of the anvil (FIG. 8). The valve shuttle is in its forward or lowermost position with its annular surface 206 resting upon and sealing against seat 210 (as shown in FIG. 11).

A manually operable flow rate controlling throttle valve 258 (FIG. 1) is now opened to supply a fluid such as air under pressure from a pump (not shown) through a pressure regulating valve 260 and a supply hose 262 to input port 220. The air flows through the conduits 228, 226 and 224 to the passage 219 around the periphery of the shuttle and thence flows to rear chamber 212 since flow to front chamber 214 is blocked by the shuttle. Pressurized air from chamber 212 flows through conduit 232 through the return ports, hoses 94 and 96, and into the return chamber 74, from whence the air pressure is applied via conduits 122 and recess 120 to and between the adjoining surfaces of the piston and anvil.

At this time front chamber 214, connected to the annular chamber 60 via hoses 246 and 248, is at atmospheric pressure since the upper portion of the annular chamber 60, above the piston, is vented to atmosphere by the ports 78*a*, etc. and ports 76*a*, etc. Higher pressure at the rear end of the shuttle 200 and lower pressure on the forward end of the shuttle operate to maintain the shuttle in the forward position or to move it to this position if it is not so disposed.

Pressure in recess 120 raises the piston 100 within the annular chamber and, after the piston has passed the ports 78*a*, 78*b*, etc., these are closed by the piston. Pressure in the front valve chamber 214 increases as the air within the annular chamber above the piston is compressed by rearward motion of the piston. As the bottom of the piston reaches the apertures 78*a*, 78*b*, of the outer sleeve, the sealing of these apertures by the piston is removed and return chamber 74, together with the rear valve chamber 212 in communication therewith, is subject to a decrease in pressure. As the piston approaches the rear end of its stroke, there is a higher pressure in the front valve chamber 214 and a relatively lower pressure in the rear valve chamber 212 whereby the pressure differential forces the valve shuttle rearwardly to block the flow of pressurized fluid from conduit 224 into rear chamber 212 and to allow flow of pressurized supply fluid from conduit 224 into front chamber 214.

Now, since the annular chamber 60 below the piston is vented to atmosphere and the front valve chamber 214 is under the high supply pressure, the piston is driven downwardly by the high supply pressure transmitted from the front chamber 214 to the upper side of the piston via hoses 246, 248. As the lower end of the piston passes the apertures 78*a*, 78*b*, etc. these are closed and sealed. Pressure in return chamber 74 and rear valve chamber 212 begins to increase and, as the rear end of the piston passes the vent apertures 78*a*, etc. the upper portion of the annular chamber 60 is vented to atmosphere and pressure in the front valve chamber 214 drops. The shuttle is now moved forwardly by the pressure differential and the next cycle commences. The ballast plates downwardly preload the housing by an amount sufficient to overcome any tendency of the pressurized gas in chamber 60 above the piston to raise the housing during the down stroke of the piston. This maintains contact of the anvil, drive head, adapter collar and pipe with one another and eliminates or at least decreases hammer bounce.

At the end of its downward or forward stroke, the piston directly strikes the rear surface of the anvil, tending to further project the anvil from the forward end of the annular chamber. In fact, the anvil does travel a short distance forwardly of the chamber because of the impact, the amount of such travel depending largely upon the force of the blow and the resistance to anvil motion. The impact of the piston on the anvil is transmitted to the drive head 130 which also moves forwardly of the hammer housing for a short distance and, in turn, transmits the impact to the adapter collar which in turn transmits the blow to the upper end of the casing. Thus, the anvil, the drive head, the collar and casing, are all driven forwardly of the hammer housing, downwardly by a short distance which may be in the order of one inch or less. This position is illustrated in FIG. 10.

As soon as the anvil is projected forwardly of its maximum retracted position, the housing weight is no longer taken by the seating of the forward face of the retainer upon the rearwardly facing shoulder of the anvil and the housing drops downwardly until such seating of the retainer is again achieved. Thus as the piston is driven upwardly, beginning the next cycle, the anvil is again retracted within the annular housing, or more specifically, the housing is moved forwardly with respect to the anvil. The forward motion of the housing transmits a second blow to the anvil which is then in position to receive the next impact blow of the piston. The valve porting is arranged to provide higher pressures and flow rates (less pressure drop) to the chamber at the rear of the piston than at the front of the piston to provide greater force to drive the piston forward.

As the drill string 26 is rotated by the rotary head mechanism and the casing 30 is driven by the hammer, material dislodged at the bottom of the well is removed by a stream of pressurized air directed through a hose (not shown) into the rotary head and then down through the hollow drill string for return upwardly through the annular space between the casing and the drill string from which it is discharged via the discharge fitting 138, following a path indicated by the arrows in FIG. 2. Seal 156 prevents the debris laden air stream from flowing upwardly past the seal into the open end of the piston chamber where it might adversely affect the hammer operation. The use of a flexible discharge fitting considerably lengthens the fitting life in the presence of the high impact rate of the described hammer. A rigidly connected fitting will not last as long as the described resiliently connected fitting under these conditions.

The energy of the impact blows imparted to the anvil by the piston depends upon the weight and speed of the piston, and the pressure supplied to valve 190. The impact energy of each piston blow is readily controllable by varying the magnitude of pressure (by control of pressure regulator 260) of supply fluid fed to the valve 190 via input port 220. Surprisingly the piston cycling rate varies relatively little as pressure is varied to vary impact energy. Although other factors such as friction, the mass of the piston, the mass of the shuttle, the length of the hoses, the volume of the various air chamber, and the air passage dimensions, will affect the rate of piston reciprocation, it is the variation of magnitude of the supply pressure to valve port 220 that primarily determines the variation of energy of the piston blows. By keeping the weight of the piston low, impact energy is more readily controlled by the supply pressure and a relatively high rate of cycling of a relatively low mass may be achieved.

It is highly important in drilling of water wells by methods described herein, to provide a controllable impact of relatively low energy at a high rate. This will produce more efficient and effective casing driving than is produced with the use of the conventional low rate, high energy blows of the massive rams of prior art. All of the structure of the hammer itself and of the casing connections, whether they be welded connections or threaded connections, more readily withstand lower energy blows. Delivering low energy blows at a rapid rate may provide a driving energy that, when summed over a given period of time, is equivalent to that achieved with high energy blows at a lower rate. However, the high frequency, low energy driving blows are more efficient and less destructive to the hammer and casing. High energy blows of a heavy ram are more likely to cause the leading edge of the casing to be bent or otherwise damaged upon encountering a boulder, whereas rapid, low energy blows may chip and crack the boulder before the casing edge is damaged.

Further, by employing an arrangement wherein the energy of the driving blows is determined largely by applied pressure and only to a relatively lesser extent by weight of the driving element (e.g., the reciprocating piston or ram), the energy of each blow is more readily controlled. In other words energy of a small, light piston is readily varied. It is only necessary to change the pressure of the air supply by means of a conventional pressure regulating valve to change the impact energy delivered. Therefore, with the described arrangement, merely by regulating the amount of pressure supplied to the valve 190, the rate of driving of the casing may be readily adjusted for optimum coordination with the rate of penetration of the rotary drill string.

In some situations, it is desirable that the drill bit be operated at a predetermined distance ahead of the leading end of the casing that is being driven therewith. The two, the drill string and the casing, should be advanced at the same rate. The described arrangement facilitates adjustment of casing driving rate by merely adjusting the amount of pressure supplied to the valve. The pressure is adjusted in a sense to decrease the difference between the rates of advance of the drill string and casing. Any difference in such rates of advance is readily observed by observing the position of the hammer relative to the rotary head.

The described hammer has a number of additional advantages, including its compact size and relatively low weight, both of which make it significantly easier to handle, and which derive, at least in part, from the use of a small, lightweight piston repetitively driven at a high speed. The annular piston has a substantially uniform cross section. No piston rod is needed since the piston itself directly strikes the anvil. The entire hammer can be more compact and the annular piston is made smaller and lighter for increased rate of reciprocation. The light weight of the piston requires less air flow and, together with ready adjustability for minimum energy impact, uses less energy overall. For driving six, eight, ten or twelve inch casing (using the same hammer with different sized adapter collars), the hammer has an overall length of 62 inches which permits the use of standard 20 foot lengths of casing on a conventional drill rig with the hammer mounted below the rotary head. Prior devices, such as apparatus built according to the Cook patents, have such excessive length that the conventional drilling rig must be extended to accommodate the casing drive. Such extension is costly and may take several days not counting the time of travel to and from the repair yard.

The exemplary mechanization of the hammer described herein employs a piston of about 100 pounds in weight, ten inches long and ten inches in outside diameter, having one inch thick walls. The annular air chamber is sized for a 14 inch piston which provides approximately 1,490 foot pounds of energy per blow at a pressure of about 50 pounds per square inch supplied to the valve (calculated without allowing for friction and other losses). As previously mentioned, the air supply is regulated to control energy of impact and may be varied within the range of 30 to 150 pounds per square inch, which, with the described hammer, drives the piston, with relatively little variation in frequency, at about 320 to 430 blows per minute and with a consumption of about 150–400 cubic feet of air per minute. Thus a driving force is transferred to the casing in many small blows whereby stresses on casing joints and welds are reduced considerably. The high rate of blows is sufficient to maintain an effectively continuous motion of the casing in the ground, and thus avoids or minimizes effects of static friction between the casing and the ground. Impact energy of the piston may be adjusted according to different ground characteristics, total length of casing in the earth and other factors.

The capability of adjusting impact force also allows adjustment to employ only the minimum amount of force necessary to drive the casing at the speed of drill string advance and neither need be stopped to wait for the other. The use of many small blows and adjustability of impact magnitude also cooperate to keep damage to the casing at a minimum. This arrangement of many small blows is more effective in hard ground and boulders and less damaging to the driving end of the casing since it chips at hard ground and boulders instead of attempting to drive through in large steps.

The total weight of the hammer is approximately 2,500 pounds. Adjustability of valve supply air pressure will provide an impact energy per blow estimated to be adjustable within the range of about 500 to 3,500 foot pounds. An impact rate of 200–500 blows per minute is preferred. A significantly higher rate may adversely affect the casing welds, may require much greater mass of the pre-loading ballast plates, and may require greatly increased air flow rates and pressures, whereas a significantly lower rate would obviate advantages described above.

Figure 13:
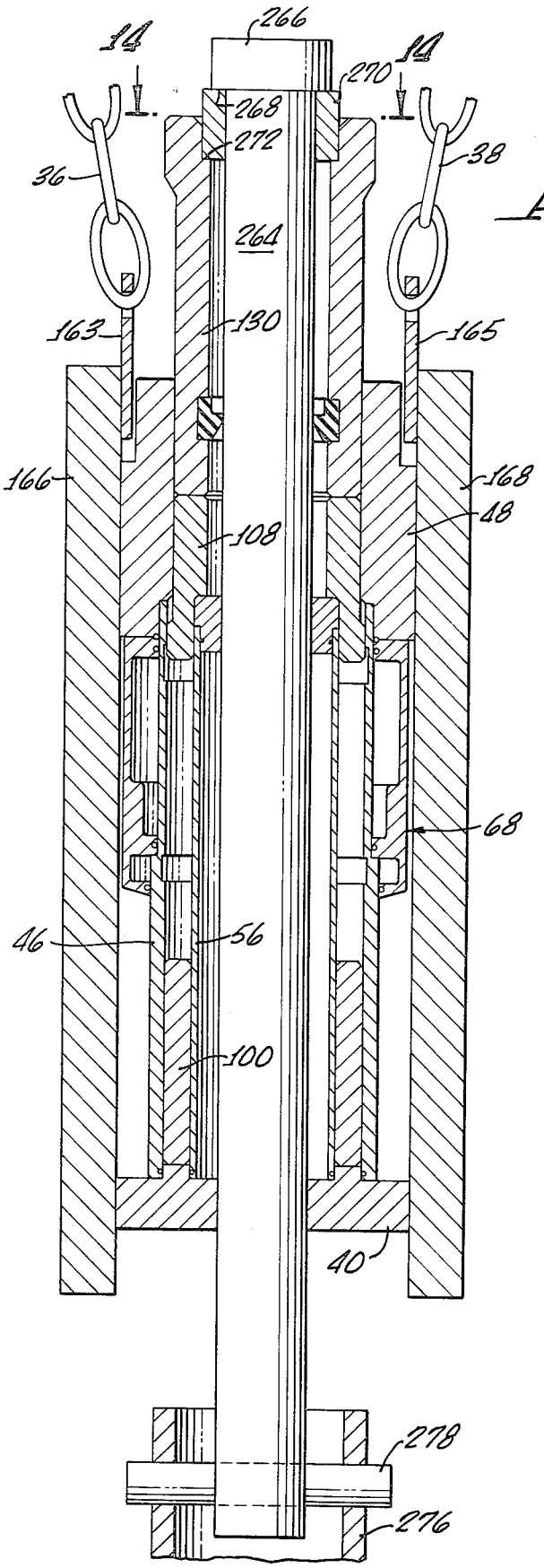
FIG. 13 illustrates the hammer reversed for pipe pulling.
Figure 14:
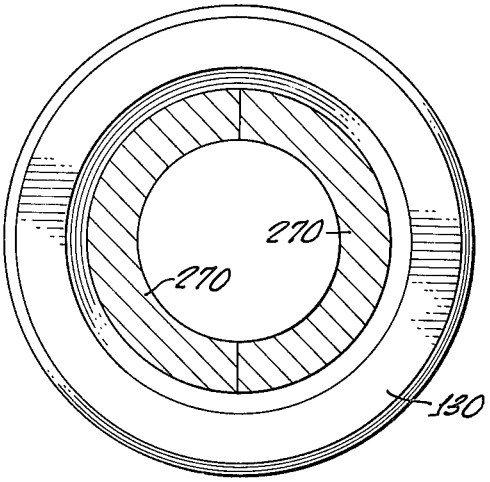
FIG. 14 is a section taken on lines 14—14 of FIG. 13.

The described hammer is readily adapted for use in pulling casing if deemed necessary or desirable. To this end, as shown in FIG. 13, the collar suspending brackets 163, 165 are employed to suspend the entire hammer from the rotary head with the forward end of the hammer pointing upwardly and its rearward end hanging downwardly. The hammer is suspended upside down from the chains 36, 38 that suspend the hammer in the upright position. Adapter collar 134 is not employed for pulling casing. Instead there is provided a tension member in the form of a tube or rod 264 having an enlarged head 266 or some other device affixed to its upper end and having a lower surface, such as the shoulder 268 of enlarged head 266, that rests upon an annular compression ring 270 that seats upon an internal shoulder 272 on the now upper end of the drive head 130 of the hammer. Tension rod 264 extends downwardly through the entire length of the inverted hammer and a short distance into the upper end of a casing 276 that is to be pulled. A pair of diametrically opposed holes is made in the casing for alignment with a diametral hole formed near the lower end of the tension rod 264. A pin 278 is then inserted through the horizontally aligned holes at the upper end of the casing and at the lower end of the tension member to connect the two together. It will be readily appreciated that many other types of detachable connections may be employed to attach the lower end of the tension rod 264 to the upper end of the casing 276 that is to be pulled. Now the suspension of the rotary head is operated to exert an upward pull on the head which thus exerts an upward pull on chains 36, 38, tending to lift the entire hammer and thereby tending to lift the tension member which exerts an upward pull upon the casing. The hammer is operated to reciprocally drive the piston which thus imparts a rapid series of upwardly directed impact blows upon collar 270. The collar transmits the impact blows to the enlarged head of the tension member which readily pulls the casing as desired. Just as in the casing driving, the force of the impact blows is readily adjusted to provide the minimum force required to pull the casing at a reasonable rate. As previously mentioned, this adjustment of impact energy is simply achieved by operation of a manually or remote controlled pressure regulating valve.

The described pipe hammer, although initially designed for driving of water well casing while the well is being drilled, it is readily adapted for driving of many other types of casing, all of which can be driven more readily at the same time that the well is being drilled by rotary or percussive or other techniques and employing some fluid such as air or a liquid slurry for removing material from the well as it is drilled. A hammer of the type described herein is useful, with different size adapter collars, for driving of casing up to twelve inches in diameter. A larger hammer may be readily constructed employing principles of the present invention for driving still larger casing, casing of 16 inch and larger diameter, such as may be used for surface casing of oil wells for example. Among significant advantages of the described apparatus are the lightweight, small size, the use of a small lightweight piston, and the provision of a high rate of short strokes of readily controllable impact energy.

The foregoing detailed description is to be clearly understood as given by way of illustration and example only, the spirit and scope of this invention being limited solely by the appended claims.

What is claimed is:

1. A pipe hammer comprising an end cap, inner and outer concentric sleeves fixed to said end cap in radially spaced relation to each other to define an annular chamber closed at one end by said end cap, an annular piston slidably mounted in said chamber, an annular anvil slidably mounted in and sealing the other end of said chamber, means for radially positioning said sleeves relative to each other at said other end of the chamber to maintain concentricity of said sleeves, said means comprising a forward housing around said outer sleeve, and annular retainer within said inner sleeve, and means for connecting said housing and retainer to said end cap, means for reciprocating said piston within said chamber to cause the piston to repetitively strike said anvil, and means for receiving blows from said anvil and transmitting such blows to a pipe to be driven.

2. The apparatus of claim 1 wherein said piston has a uniform cross section.

3. A pipe hammer comprising an end cap, inner and outer concentric sleeves fixed to said end cap is radially spaced relation to each other to define an annular chamber closed at one end by said end cap, an annular piston slidably mounted in said chamber, an annular anvil slidably mounted in and sealing the other end of said chamber, means for radially positioning said sleeves relative to each other at said other end of the chamber to maintain concentricity of said sleeves, means for reciprocating said piston within said chamber to cause the piston to repetitively strike said anvil, means for receiving blows from said anvil and transmitting such blows to a pipe to be driven, first and second tension means connected to said end cap and to said inner and outer sleeves, respectively, for fixing said sleeves to said end cap, said first tension means being positioned within said inner sleeve.

4. The hammer of claim 3 wherein said means for radially positioning said sleeves comprises an annular retainer abutting said inner sleeve at said other end of said chamber, said first tension means being connected to said retainer to hold it against said inner sleeve.

5. The hammer of claim 4 wherein said anvil includes a portion extending outwardly of said chamber, and interengaging means on said retainer and said anvil portion for limiting motion of said anvil.

6. A pipe hammer comprising an end cap, inner and outer concentric sleeves fixed to said end cap in radially spaced relation to each other to define an annular chamber closed at one end by said end cap, an annular piston slidably mounted in said chamber, an annular anvil slidably mounted in and sealing the other end of said chamber, means for radially positioning said sleeves relative to each other at said other end of the chamber to maintain concentricity of said sleeves, means for reciprocating said piston within said chamber to cause the piston to repetitively strike said anvil, means for receiving blows from said anvil and transmitting such blows to a pipe to be driven, first and second tension means connected to said end cap and to said inner and outer sleeves, respectively, for fixing said sleeves to said end cap, said second tension means comprising a front housing abutting said outer sleeve at said other end of said chamber and means connected to said housing to hold it against said outer sleeve.

7. The hammer of claim 6 wherein said anvil includes a portion extending outwardly of said chamber, and interengaging means on said housing and anvil for limiting motion of said anvil.

8. A pipe hammer comprising an end cap, inner and outer concentric sleeves fixed to said end cap in radially spaced relation to each other to define an annular chamber closed at one end by said end cap, an annular piston slidably mounted in said chamber, an annular anvil slidably mounted in and sealing the other end of said chamber, means for radially positioning said sleeves relative to each other at said other end of the chamber to maintain concentricity of said sleeves, means for reciprocating said piston within said chamber to cause the piston to repetitively strike said anvil, means for receiving blows from said anvil and transmitting such blows to a pipe to be driven, said means for receiving blows from said anvil comprising an annular drive head mounted for limited sliding motion to said outer sleeve and having one end positioned to receive impact blows from said anvil, an internal annular seal mounted to the interior of said drive head for sealing against the outer surface of a tube extending through said inner sleeve, through said anvil, through said drive head, and through a pipe to be driven, said drive head including a discharge aperture positioned on a side of said seal remote from said piston.

9. A pipe hammer comprising a housing having a bore including means defining an annular chamber circumscribing said bore, means on said housing for sealing one end of said chamber, an annular piston mounted for reciprocation in said chamber, an annular drive head slidably mounted at an end of said housing remote from said one chamber end, anvil means movably mounted to said housing between said piston and drive head for sealing the other end of said chamber, said anvil means comprising an annular anvil mounted for slidable motion relative to each of said housing, said piston and said drive head, whereby impact of said piston upon said anvil causes said anvil to impact said drive head, means responsive to said drive head for transmitting driving blows to a pipe, and means for reciprocating said piston within said chamber.

10. The hammer of claim 9 wherein said piston comprises an annular ram of substantially uniform cross-section that directly strikes the anvil upon reciprocation of the piston.

11. The hammer of claim 9 wherein said anvil has a driven portion within said chamber adapted to be repetitively struck by said piston, said drive portion extending from said chamber.

12. The hammer of claim 9 wherein said means for reciprocating said piston comprises valve means for admitting pressurized fluid to said chamber alternately at opposite ends thereof to forcibly drive said piston in both directions of its reciprocation, at a rate that maintains substantially continuous motion of said pipe.

13. The hammer of claim 9 wherein said means for reciprocating said piston comprises means for driving said piston back and forth at a high rate to cause the piston to strike said anvil with relatively light but rapid blows, and means for transmitting motion of said housing to said anvil as the piston is driven away from said anvil to provide a second blow to said pipe upon each complete reciprocation of said piston.

14. The hammer of claim 13 wherein said means for reciprocating said piston comprises pneumatic valve means for supplying pressurized gas to said annular chamber at opposite sides of said piston, and means for varying the pressure of said gas to control the energy of said driving blows.

15. The hammer of claim 14 wherein said valve means comprises a valve body displaced from the axis of said chamber and having a pressure inlet and first and second operating ports, first conduit means for connecting said first port to said chamber at one end of said piston, second conduit means for connecting said second port to said chamber at the other end of said piston, and shuttle means in said body for alternately blocking one or the other of said ports while allowing fluid communication between said inlet and the unblocked operating port.

16. The hammer of claim 9 including a tension device extending through said piston and anvil means, means for transmitting blows from said anvil means to said tension device, and means for connecting said tension device to a member to be pulled.

17. The hammer of claim 16 wherein said housing is adapted to be supported substantially vertically with said anvil means at an upper end thereof, said means for transmitting blows to said tension device comprising a striking head fixed to said tension device above said anvil, said tension device extending downwardly through said housing to a point below said hammer.

18. The hammer of claim 9 wherein said annular drive head has a discharge port, an internal seal fixed to the drive head between said port and said anvil, and an outlet fitting resiliently secured to said drive head in alignment with said discharge port.

19. The hammer of claim 18 wherein said outlet fitting comprises a conduit section having an end extending into said discharge port and a pair of laterally extending arms on either side of said conduit section, and bands encircling said arms and said drive head for securing said arms to said drive head.

20. The hammer of claim 19 wherein said conduit section and arms are formed of an integral body of resilient material.

21. The hammer of claim 9 wherein said anvil has a driven portion within said chamber adapted to be struck by said piston as the piston moves toward the anvil and including means on said anvil adapted to be struck by said housing as the piston moves away from the anvil.

22. A pipe hammer for driving casing that has a drill string extending through the casing, said pipe hammer comprising a rear cap having a bore adapted to receive said drill string, an outer sleeve having a rear end seated on said rear cap coaxial with said bore, a front housing seated on the front end of said outer sleeve, tension means for securing said front housing to said rear cap to fix said outer sleeve to said rear cap, an inner sleeve having a rear end seated on said rear cap and positioned coaxially of said bore, an annular retainer seated on the front end of said inner sleeve, tension means for securing said retainer to said rear cap to fix said inner sleeve to said rear cap, said sleeves defining an annular chamber therebetween closed at the rear end of said sleeves by said rear cap, an annular anvil positioned between said sleeves at the front ends thereof in sealing relation to said chamber, said anvil having a limited slidable motion within said chamber, an annular piston slidably positioned within said chamber, valve means for introducing pressurized gas into said chamber alternately at opposite sides of said piston to reciprocate said piston within said chamber and cause it to repetitively strike said anvil, and means for transmitting blows from said anvil to casing to be driven by said hammer.

23. The hammer of claim 22 wherein said last mentioned means comprises an annular drive head slidably carried by said front housing and having an upper end adapted to be engaged by said anvil, a discharge port formed in said drive head, and means on said drive head positioned between said anvil and said discharge port for sealing the space between said drive head and a drill string extending through said hammer.

24. The hammer of claim 23 including an adapter carried below said drive head, said adapter having a portion adapted to seat upon the upper end of a casing to be driven and having a drive surface in engagement with a lower end of said drive head.

25. The hammer of claim 22 including ballast means resiliently connected to said rear cap.

26. The hammer of claim 22 wherein said retainer includes a forward portion of relatively enlarged diameter having a rearwardly facing shoulder in abutment with the forward end of said inner sleeve.

27. The hammer of claim 26 wherein said retainer includes a portion having an outer surface in close engagement with the inner surface of said inner sleeve and cooperating with said anvil to maintain concentricity of the forward ends of said sleeves.

28. The method of employing a hollow pipe driving hammer for both driving and pulling pipe comprising positioning the hammer upon a pipe to be driven, operating the hammer to transmit downwardly directed blows to the pipe, turning the hammer upside down above the pipe, extending a tension member through the hammer, connecting a lower end of the tension member to the pipe, and operating the hammer to transmit upwardly directed blows to an upper portion of said tension member.

29. The method of driving and at least partially pulling casing comprising positioning around the casing a cylinder having an annular chamber, an annular piston, and an annular anvil, positioning a drive member between the anvil and the casing to be driven, reciprocating the piston to cause it to impact the anvil and to cause the drive member to impact downwardly upon the casing and drive it into the ground, turning the cylinder, piston, anvil and drive member upside down, extending a tension member through the piston, anvil and drive member, connecting a lower end of the tension member to the casing, and reciprocating the piston to cause it to impact the anvil and to cause the drive member to impact upwardly upon an upper portion of the tension member, whereby the tension member will pull the casing upwardly.

* * * * *

UNITED STATES PATENT AND TRADEMARK OFFICE

CERTIFICATE OF CORRECTION

PATENT NO. : 4,232,752

DATED : November 11, 1980

INVENTOR(S) : Ernest D. Hauk and Jesse C. Kirkpatrick

It is certified that error appears in the above-identified patent and that said Letters Patent are hereby corrected as shown below:

Claim 1, lines 1 through 9 should be corrected to reflect the correct paragraphing, as follows:

1. A pipe hammer comprising an end cap, inner and outer concentric sleeves fixed to said end cap in radially spaced relation to each other to define an annular chamber closed at one end by said end cap, an annular piston slidably mounted in said chamber, an annular anvil slidably mounted in and sealing the other end of said chamber, Claim 1, line 14, "and" should be --an--.

UNITED STATES PATENT AND TRADEMARK OFFICE

CERTIFICATE OF CORRECTION

PATENT NO. : 4,232,752

DATED : November 11, 1980

INVENTOR(S) : Ernest D. Hauk and Jesse C. Kirkpatrick

It is certified that error appears in the above-identified patent and that said Letters Patent are hereby corrected as shown below:

Claim 3, lines 1 through 9 should be corrected to reflect the correct paragraphing, as follows:

3. A pipe hammer comprising an end cap, inner and outer concentric sleeves fixed to said end cap in radially spaced relation to each other to define an annular chamber closed at one end by said end cap, said end cap, an annular piston slidably mounted in said chamber, an annular anvil slidably mounted in and sealing the other end of said chamber,

UNITED STATES PATENT OFFICE

CERTIFICATE OF CORRECTION

PATENT NO. : 4,232,752

DATED : November 11, 1980

INVENTOR(S) : Ernest D. Hauk and Jesse C. Kirkpatrick

It is certified that error appears in the above-identified patent and that said Letters Patent are hereby corrected as shown below:

Claim 6 , lines 1 through 9, should be corrected to reflect the correct paragraphing, as follows:

6. A pipe hammer comprising and end cap, inner and outer concentric sleeves fixed to said end cap in radially spaced relation to each other to define an annular chamber closed at one end by said end cap, an annular piston slidably mounted in said chamber, an annular anvil slidably mounted in and sealing the end of said chamber, Signed and Sealed this

*Fifteenth* Day of *December 1981*

[SEAL]

*Attest:*

GERALD J. MOSSINGHOFF

*Attesting Officer*

*Commissioner of Patents and Trademarks*